US010173816B2

(12) United States Patent
Danks et al.

(10) Patent No.: US 10,173,816 B2
(45) Date of Patent: Jan. 8, 2019

(54) CLOSURE WITH A REMOVABLE MEMBRANE HAVING AN IMPROVED SEPARABILITY CONFIGURATION

(71) Applicant: AptarGroup, Inc., Crystal Lake, IL (US)

(72) Inventors: Christopher Danks, Waukesha, WI (US); John Wisniewski, Wauwatosa, WI (US)

(73) Assignee: APTARGROUP, INC., Crystal Lake, IL (US)

( * ) Notice: Subject to any disclaimer, the term of this patent is extended or adjusted under 35 U.S.C. 154(b) by 45 days.

(21) Appl. No.: 15/306,259

(22) PCT Filed: Jul. 22, 2014

(86) PCT No.: PCT/US2014/047593
§ 371 (c)(1),
(2) Date: Oct. 24, 2016

(87) PCT Pub. No.: WO2016/014033
PCT Pub. Date: Jan. 28, 2016

(65) Prior Publication Data

US 2017/0050780 A1 Feb. 23, 2017

(51) Int. Cl.
*B65D 51/22* (2006.01)
*B65D 5/74* (2006.01)
(Continued)

(52) U.S. Cl.
CPC ..... *B65D 51/228* (2013.01); *B65D 5/746* (2013.01); *B65D 47/103* (2013.01);
(Continued)

(58) Field of Classification Search
CPC ..... B65D 47/0804; B65D 47/0814; B65D 47/0838; B65D 47/36; B65D 47/103; B65D 5/746; B65D 2251/0093
(Continued)

(56) References Cited

U.S. PATENT DOCUMENTS 4,568,005 A * 2/1986 Jalovec ..... B65D 47/0866 215/319
4,598,834 A * 7/1986 Singletary, Jr. ..... A61J 1/10 150/154

(Continued)

FOREIGN PATENT DOCUMENTS

WO WO 2010134931 A1 * 11/2010 ..... B65D 47/0809

*Primary Examiner* — Chun Cheung
*Assistant Examiner* — Brijesh V. Patel
(74) *Attorney, Agent, or Firm* — Wood, Phillips, Katz, Clark & Mortimer

(57) ABSTRACT

A closure (20) is provided to selectively permit or restrict communication between the exterior and the interior of a system that has an opening between the exterior and interior. The closure (20) includes a closure body (24) that defines an access passage (30) and a membrane (60) that initially occludes the access passage (30). The connection of the membrane (60) to the body (24) is defined by a tearable portion (68) of material that defines a tear path along which the material can be torn. The tear path has; (A) a first separation path (80) where separation of the membrane (60) from the body (24) initially originates; and (B) a second separation path (90) where separation of the membrane (60) from the body (24) terminates. The second separation path (90) has a generally tapered configuration.

2 Claims, 8 Drawing Sheets

(51) Int. Cl.
*B65D 47/10* (2006.01)
*B65D 75/58* (2006.01)
*B65D 77/30* (2006.01)

(52) U.S. Cl.
CPC ..... *B65D 75/5866* (2013.01); *B65D 77/30* (2013.01); *B65D 2251/0025* (2013.01); *B65D 2251/0093* (2013.01)

(58) Field of Classification Search
USPC ..... 220/258.2, 258.5, 266, 270; 215/253–255; 222/541.5, 541.9
See application file for complete search history.

(56) References Cited

U.S. PATENT DOCUMENTS 4,838,429 A * 6/1989 Fabisiewicz ..... B65D 75/5838 383/205
5,735,426 A * 4/1998 Babcock ..... B65D 5/746 215/256
6,179,147 B1 * 1/2001 Mogard ..... B65D 5/746 220/258.2
6,367,670 B1 * 4/2002 Warner ..... B65D 47/0804 222/556
6,390,342 B1 * 5/2002 Mabee ..... B65D 47/103 222/541.9
6,761,279 B1 * 7/2004 Martin ..... B65D 43/169 220/254.3
8,066,141 B2 * 11/2011 Casale ..... B65D 5/749 215/232
8,727,148 B2 * 5/2014 Soehnlen ..... B65D 47/0838 215/200
2004/0206637 A1 10/2004 Sierra-Gomez et al.
2005/0092750 A1 5/2005 Lohrman et al.
2005/0205618 A1 * 9/2005 Mabee ..... B65D 5/746 222/541.9
2008/0078775 A1 4/2008 Steiger et al.
2010/0140266 A1 * 6/2010 Lohrman ..... B65D 47/0838 220/254.3
2010/0140268 A1 6/2010 Lohrman
2010/0187265 A1 * 7/2010 Baughman ..... B65D 25/44 222/529
2010/0294812 A1 * 11/2010 Lohrman ..... B65D 39/0005 222/541.9
2011/0100948 A1 5/2011 Lohrman et al.
2012/0074180 A1 * 3/2012 Kallenbach ..... B65D 47/06 222/567
2012/0234848 A1 * 9/2012 Muramoto ..... B65D 5/746 220/789
2012/0312868 A1 * 12/2012 Sanfilippo ..... B65B 1/02 229/221
2012/0318798 A1 12/2012 Domoy
2015/0203245 A1 * 7/2015 Gayer ..... B65B 7/2842 53/492
2015/0203263 A1 * 7/2015 Minnette ..... B65D 77/2032 220/270
2015/0217910 A1 * 8/2015 Vogel ..... B65D 47/40 222/109

* cited by examiner

CLOSURE WITH A REMOVABLE MEMBRANE HAVING AN IMPROVED SEPARABILITY CONFIGURATION

TECHNICAL FIELD

This invention relates to a closure having a separable membrane for initially preventing, but subsequently permitting, communication between the exterior and interior of a system.

BACKGROUND OF THE INVENTION AND TECHNICAL PROBLEMS POSED BY THE PRIOR ART

Closures are employed to selectively prevent or permit communication between the exterior and interior of a system (e.g., machine, equipment, containment system (including bottles and pouches), etc.) through an opening in the system. A typical closure includes a (1) receiving structure (e.g., a body, base, fitment, etc.) at an opening to the system interior, and (2) a closing element (e.g., a separable membrane, a lid, cover, overcap, etc.).

The receiving structure can typically be either (1) a separate structure that (a) can be attached at such a system opening, and (b) defines at least one access passage through the receiving structure for communicating through such a system opening with the interior of such a system, or (2) an integral structure that is a unitary portion of such a system and that defines at least one access passage through the integral structure such that the access passage functions as the opening, per se, to the system.

The closing element typically accommodates movement relative to the receiving structure access passage between (1) a fully closed position occluding the access passage, and (2) an open position at least partially exposing the access passage.

Various substances (including lotions, creams, food items, granules, liquids, powders, small articles, etc.) may be packaged in a rigid, flexible, or collapsible containment system (e.g., bottle, pouch, portable or stationary equipment, machines or other structures, etc.) having a closure that can he opened and closed. If the containment system is a bottle, pouch, or other such container, then such a container with the closure mounted thereon and the contents stored therein may be characterized as a "package."

A closure for a system may provide an initial hermetic seal and/or may provide an initial tamper-evidency for indicating to a user that the closure integrity has been compromised. One type of such a closure includes a body having a discharge end defining at least part of the access passage (which could be, for example, a discharge flow passage) that is initially sealed closed with a separable membrane. The discharge end of the body may further be covered with a closing element that is a cap or lid that can be removed, or moved away, from the discharge end so as to "open" the discharge end and allow access to the separable membrane. Typically, a separation member, such as a pull tab or pull ring, extends from the membrane. The pull tab or ring projects above the membrane. The user initially grasps the pull tab or ring to pull the membrane so as to separate the membrane from the body discharge end at the access passage to establish communication between the exterior ambient environment and the interior of the container or other system to which the closure is mounted. A separation path (e.g., a tear path) defines the line of separation between the membrane and the remaining portion of the closure body.

Some closures with a separable membrane may be utilized in a system containing a fluent product that may be very viscous or not very viscous. This fluent product may coat the underside of the membrane. When a user grips the pull ring and tears away the separable membrane, the membrane may be carried away from the remaining portion of the closure body in a slinging motion. This separation of the membrane may fling off some of the fluent product coating the underside of the membrane, resulting in an undesirable splatter and mess. Further, when the user holds a package (e.g., bottle containing the fluent product) with one hand, and pulls the pull ring with the other hand to tear off the membrane, then the sudden release or separation of the membrane from the package may result in the recoil of the package and an undesirable ejection of the fluent product from the access passage of the closure body.

The inventors have found that it would be desirable to eliminate, or at least reduce, this unwanted slinging and/or ejection of the fluent contents by controlling the forces required to separate the membrane from the rest of the closure along the separation path.

It would additionally be beneficial if such an improved closure could be relatively easily operated to tear away the membrane, without requiring an unusually complex manipulation or series of manipulations.

It would also be beneficial if such an improved closure could be relatively easy to manufacture.

The inventors of the present invention have invented a novel structure for an improved closure for a system wherein the closure includes a tearable membrane and wherein the closure has advantageous features not heretofore taught or contemplated by the prior art.

SUMMARY OF THE INVENTION

According to broad aspects of one form of the present invention, a closure is provided to selectively permit or restrict communication between the exterior and the interior of a system that has an opening between the exterior and interior. The closure includes closure body that (A) defines an access passage through the closure body for communicating with the system opening, and (B) is either (1) a separate structure for being attached to the system at the system opening, or (2) an integral structure that (a) is a unitary part of the system, and (b) includes the access passage through the integral structure to define at least a portion of the system opening.

The closure body further has a membrane that (A) initially occludes the access passage, (B) is initially connected to a remaining portion of the closure body, and (C) includes a separation member that extends from a remaining portion of the membrane. The separation member accommodates engagement by a user to separate at least a part of the membrane from the body along at least a portion of the connection of the membrane to the body.

The connection of the membrane to the body is defined by a tearable portion of material that defines a tear path along which the material can be torn. The tear path has: (A) a first separation path where separation of the membrane from the body initially originates; and (B) a second separation path where separation of the membrane from the body terminates. The second separation path has a generally tapered configuration.

In one aspect, the first separation path has a starting point and two ending points, and the second separation path has a termination point. The first separation path starting point and two ending points define two diverging lines diverging from the starting point. The second separation path defines two converging lines each extending from a respective one of the first separation path ending points to the termination point of the second separation path, whereby the membrane can be separated from the body along the entire connection of the membrane to the body.

According to other aspects, the closure has a second separation path termination point that is on a curved locus defined by the convergence of the two converging lines, and the first separation path and the second separation path connect at the first separation path ending points on a curve.

In another aspect of the closure, at least part of the first separation path defines a diameter extending through a center point, and the shortest distance from the center point to the second separation path termination point is greater than one half of the diameter.

In yet another aspect, at least a portion of each converging line is a straight line, and the straight lines define an interior angle that is greater than 90 degrees.

According to another aspect, at least one of the first separation path and the second separation path has symmetry about the access passage.

In yet another aspect, the closure is for use with a system that includes a bottle defining the opening, and the body is initially separate from, but non-releasably attachable to, the bottle at the opening.

In another aspect, the closure is for use with a system that is a flexible pouch defining the opening and wherein part of the body is a fitment for being sealingly secured to the flexible pouch in the opening.

In a further aspect, the closure body includes a base and a spout projecting outwardly from the base, and the access passage extends through both the base and the spout, and the membrane is located within the spout.

According to another aspect, the separation member includes: (1) a stem extending outwardly from the membrane; and (2) a grippable portion extending laterally from the stem.

In another aspect, the membrane has a recessed interior portion.

It should be appreciated that the invention may include all or none of the above-described features, or include only one or more of the above-described features, or include any combination of the above-described features. Furthermore, other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

DESCRIPTION OF THE PREFERRED EMBODIMENTS

Figure 1:
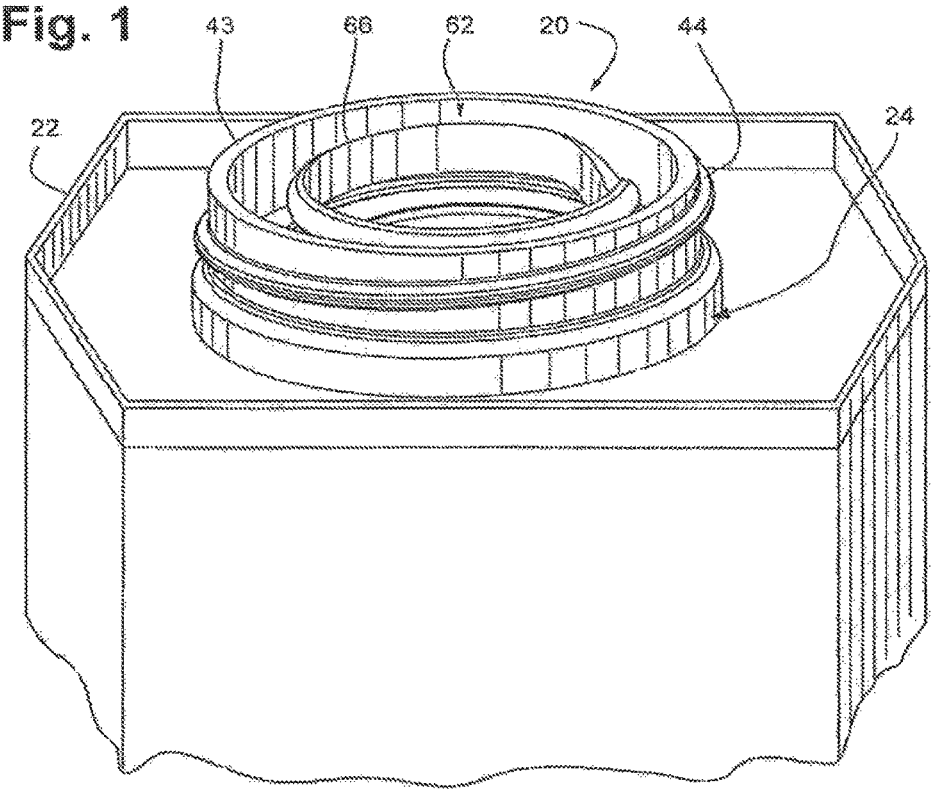
FIG. 1 is a fragmentary, isometric view of a closure installed on a container (e.g., a flexible pouch) in which a product is stored or can be stored.
Figure 2:
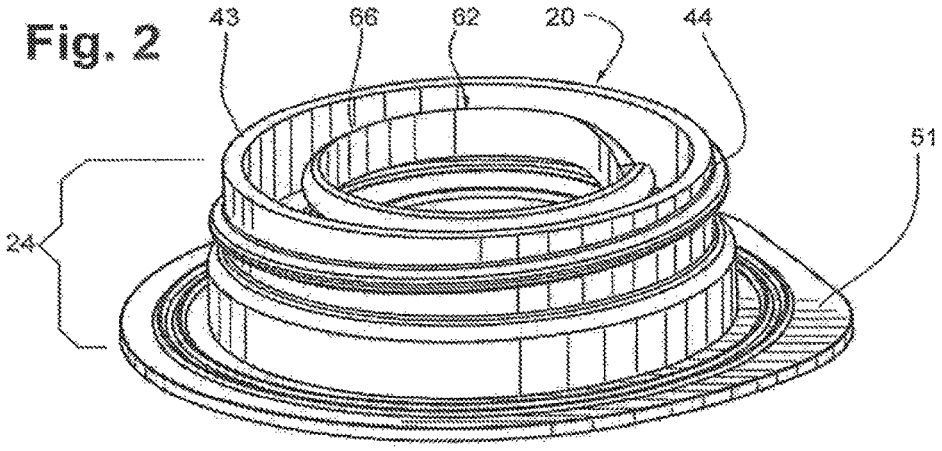
FIG. 2 is an isometric view of the closure shown in FIG. 1, and in FIG. 2 the closure is shown prior to installation on a system, wherein the closure is illustrated in the initially as-molded, fully-closed condition.

While this invention is susceptible of embodiment in different forms, this specification and the accompanying drawings disclose only some specific embodiments as examples of the invention. The invention is not intended to be limited to the embodiments so described, and the scope of the invention will be pointed out in the appended claims.

For ease of description, many figures illustrating the invention show a presently preferred embodiment of a closure in the typical orientation that the closure would have when installed at the opening of a system, such as a machine, equipment, or an upright containment system (which may be, for example, a flexible pouch, bottle, or other container), and terms such as upper, lower, horizontal, etc., are used with reference to this orientation. It will be understood, however, that the closure may be manufactured, stored, transported, used, and sold in an orientation other than the orientation described.

The inventive closure is suitable for use with a variety of conventional or special systems, the details of which, although not fully illustrated or described, would be apparent to those having skill in the art and an understanding of such systems. The particular systems, per se, that are described herein form no part of, and therefore are not intended to limit, the broad aspects of the present invention.

The embodiments of the closure illustrated in FIGS. 1-10, will typically be used on a system in the form of a containment system that contains a material or substance (e.g., a product such as a lotion, fluent food, or drink substance) that can be dispensed, or otherwise removed, from the system through the opened closure. The product may be, for example, a fluent material such as a liquid, cream, powder, slurry, or paste. If the system is a container, and if the container and closure are large enough, then the product could also be non-fluent, discrete pieces of material (e.g., food products such as nuts, candies, crackers, cookies, etc., or non-food products including various items, particles, granules, etc.) which can be removed through an open closure by hand from a container, or scooped out of a container, or ladled out of a container, or poured out of a container. Such materials may be, for example, a food product, a personal care product, an industrial product, a household product, or other types of products. Such materials may be for internal or external use by humans or animals, or for other uses (e.g., activities involving medicine, manufacturing, commercial or household maintenance, construction, agriculture, etc.).

An embodiment of a closure incorporating the present invention is illustrated in the FIGS. 1-9 wherein the closure is designated generally by reference number 20. In the first illustrated embodiment, the closure 20 is provided in the form of a separate closure which is especially suitable for being attached to a system in the form of a containment system that would typically contain contents such as a product or products consisting of articles or fluent material. Such a containment system could be a collapsible, flexible pouch, or may be a generally rigid container (which may have somewhat flexible, resilient walls), such as a bottle or tank.

The system may be some other system which may include, or be part of, for example, a medical device, processing machine, dispenser, reservoir on a machine, etc., wherein the system has an opening to the system interior. The system, per se, such as a bottle, pouch, or other containment system, or other type of system per se, does not form a part of the broadest aspects of the present invention, per se. The system may have any configuration suitable for the intended use.

If the system is a containment system such as a container, then the containment system, or a portion thereof, may be made from a material suitable for the intended application (e.g., a thin, flexible material for a pouch wherein such a material could be a polyethylene terephthalate (PET) film or a polyethylene film, or a thicker, less flexible material for a bottle wherein such a less flexible material could be injection-molded polyethylene or polypropylene).

In applications wherein the closure 20 is mounted to a container such as a bottle or pouch, it is contemplated that typically, after the closure manufacturer makes the closure 20 (e.g., by molding the closure from a thermoplastic polymer as a unitary structure in an initially closed condition, or by molding multiple pieces or components and assembling them together in an initially assembled orientation defining a fully closed condition), the closure manufacturer will then ship the closed closure 20 to a containment system filler facility at another location where the container is either manufactured or otherwise provided, and where the container is filled with a product. However, for a multi-component closure in some applications, the components of the closure 20 could be shipped by the manufacturer in an unassembled condition to the filler facility.

If the container is a collapsible pouch (22 in FIG. 1), then the closure 20 may include a suitable conventional or special fitment portion that can be attached to the pouch as the pouch is being made and filled, or as the pouch is being made but before the pouch is subsequently filled through a base of the unassembled closure 20 or through open regions of the pouch walls that are later sealed closed.

In the illustrated embodiment, the closure 20 is preferably provided in the form of a separate closure which is adapted to be attached to a system in the form of a containment system that would typically contain contents such as a product or products consisting of articles or fluent material. The illustrated preferred embodiment of the closure 20 is especially suitable for being non-removably attached (e.g., mounted or installed) on a system that is a containment system in the form of a pouch or bottle. However, it will be appreciated, that in some applications (not illustrated), it may be desirable for the closure 20 to be attached to a system in a manner that would allow a user to remove the closure 20 from the system. Further, it may be desirable for the closure to be formed as an integral, unitary part, or extension, of the system (e.g., a pouch or bottle) wherein such a unitary part or extension also (i.e., simultaneously) defines an end structure (or other portion) of the system, per se.

The illustrated embodiment of the closure 20, if initially manufactured and provided separately from the containment system, is adapted to be subsequently attached to a containment system at an opening in the system which provides access from the exterior environment to the containment system interior and to the contents (e.g., a product contained therein) after a portion of the closure 20 is breached or removed as described hereinafter.

Where the system is a bottle (not illustrated), the bottle typically includes an upper end portion or other suitable structure on some part of the bottle that defines the bottle mouth portion (i.e., a portion that defines an opening to the bottle interior), and such a mouth portion of a bottle typically has a cross-sectional configuration with which the closure 20 is designed to engage. The main body portion of the bottle may have a cross-sectional configuration that differs from the cross-sectional configuration of the bottle mouth portion. On the other hand, the bottle may instead have a substantially uniform shape along its entire length or height without any portion of reduced size or different cross-section. The bottle may have a generally rigid or flexible wall or walls which can be grasped by the user.

The embodiment of the closure 20 illustrated in the FIGS. 1-9 is especially suitable for use with a container that is either a collapsible, flexible pouch (e.g., 22 in FIG. 1) or a bottle (not illustrated) having a substantially flexible wall or walls that can be squeezed or deflected laterally inwardly by the user to increase the internal pressure within the bottle so as to force the product out of the bottle and through the opened closure. In a bottle with a flexible wall or walls, such a flexible wall or walls typically have sufficient, inherent resiliency so that when the squeezing forces are removed, the bottle walls return to the normal, unstressed shape.

In other applications it may be desirable to employ a generally rigid container, and to pressurize the container interior at selected times with a piston or other pressurizing system to force the product out through the open closure, or to reduce the exterior ambient pressure so as to suck the product out through the open closure.

On the other hand, if the closure 20 has a suitably large access passage that can be opened to communicate with the containment system interior through a large opening in the containment system, then such a closure can be used on a rigid or flexible containment system from which the contents (e.g., the product) can be accessed through the opened closure and removed by pouring out the contents, or by scooping out the contents, or by withdrawing the contents by hand or with an instrument, etc.

In other applications, contents might be added through the opened closure to the containment system.

In still other applications for use with a system which may be a product containment system or other type of system, the closure 20 can function to permit or prevent the egress or ingress of ambient atmosphere, or other substances, relative to the system on which the closure 20 is installed.

In the preferred illustrated embodiment, the closure 20 includes a closure body 24. As explained hereinafter, the user's partial or complete opening of the closure 20 may permanently alter the physical condition of the closure 20 so as to create or provide a "tamper-evident" indication to subsequent users of the partial or complete opening.

The closure body 24 is preferably molded from a suitable thermoplastic material such as polyethylene, polypropylene, or the like. In a presently preferred form of the closure 20, the closure body 24 is molded as a unitary structure from linear low density polyethylene (LLDPE). Other materials may be employed instead.

FIG. 1 illustrates the completed closure 20 with the closure body 24 installed in an initially closed condition on a flexible pouch 22 type of container. FIG. 1 may be characterized as also illustrating the closure 20 in an initially assembled orientation which prevents, but can be subsequently opened to permit, communication therethrough. The closure 20 can also include an auxiliary closing element such as a hinged lid, cap, or overcap (not shown) to cover the top of the closure body 24. If such a hinged lid, cap, or overcap is initially provided, then such an auxiliary closing element is ultimately removed by the user from the closure body 24 in order to permit communication through the closure 20.

Figure 6:
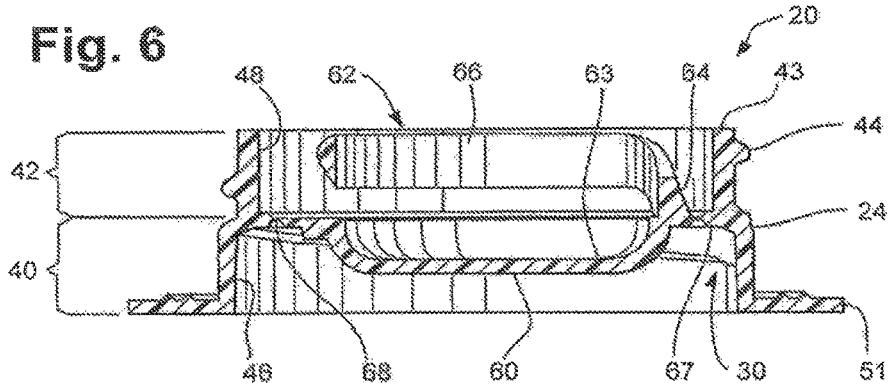
FIG. 6 is a cross-sectional view taken generally along the plane 6-6 in FIG. 5.

With reference to FIG. 6, the body 24 defines an internal access passage 30 through the closure body 24. The access passage 30 communicates with the system opening to permit removal of the contents from the interior of the system, or the addition or refilling of a substance into the system, or the ingress or egress of other substances. Referring to FIG. 6, the closure body 24 may further be characterized as having a base 40 and a spout 42 projecting outwardly from the base 40. In such a configuration, the access passage 30 extends through both the base 40 and the spout 42. The spout 42 has a distal end 43 from which a product can be discharged, or into which a substance can be introduced. The term "spout" is used herein in the sense of a tall or a short, upwardly (i.e., axially outwardly) extending boss or other structure further defining the access passage 30.

In the first illustrated embodiment, as best viewed in FIG. 6, the spout 42 may include one cam or cam follower, such as the illustrated thread 44. The thread 44 could be regarded as either a cam per se or a cam follower per se for engaging a thread (not illustrated) on a suitable auxiliary closing element (not illustrated), such as a hinged lid, cap, or overcap. That is, if the thread 44 on the spout 42 is regarded as a cam, then the closing element thread may be regarded as a cam follower. On the other hand, if the spout thread 44 is regarded as the cam follower, then the closing element thread may be regarded as the cam. In either ease, it is to be realized that the relative rotational movement between the closing element and the body 24 could result from rotating the closing element relative to the body 24 being held stationary, or could result from rotating the body 24 (along with the attached system) relative to the closing element being held stationary, or could result from rotating both the closing element and body 24 simultaneously in opposite directions. It will be appreciated that, in the broadest concept of the present invention, the spout 42 need not be provided with any thread 44, such as in the case where the closing element is a press-on cap, or where no auxiliary closing element is provided.

As best shown in FIG. 6, the first illustrated embodiment of the closure 20 has a base 40 with a first interior surface 46 defined by a first circumference of the access passage 30. The spout 42 has a second interior surface 48 defined by a second (smaller) circumference of the access passage 30. It will be further appreciated that the first circumference of the access passage 30 need not be greater than the second circumference of the access passage 30. It is to be understood that the access passage 30 need not be circular as shown. The access passage 30 may be elliptical, polygonal, or some other regular or irregular shape.

As further shown in FIG. 6, opposite the distal end 43 of the spout 42, the body 24 may include a suitable structure for being mounted to a system, such as a containment system that may be a collapsible, flexible pouch 22 (illustrated in FIG. 1) or a bottle (not illustrated), or other containment system, or other structure of a system to which the closure 20 is intended to be attached. For use with the collapsible, flexible pouch 22, the bottom portion of the closure body 24 includes a flange 51 (FIG. 6) for being ultrasonically welded or sealed, heat-sealed, or otherwise secured to a wall portion of the pouch 22 around an opening in the wall portion of the pouch 22. For use with other types of pouches, the body 24 may include a suitable conventional or special fitment (e.g., a "boat-shaped," heat-sealable fitment (not shown) such as disclosed in the U.S. Pat. No. RE 39,520, the details of which form no part of the broad aspects of the present invention).

If the containment system is a pouch 22, then it is presently contemplated that most pouch manufacturers will prefer to have the closure 20 provided to them with a suitable fitment at the lower end, and then install the closure 20 on the pouch 22 with heat sealing techniques.

If the containment system is a bottle, then it is presently contemplated that most bottlers would prefer to have the closure 20 provided to them with the closure body 24 suitably configured with a snap-fit attachment feature or threaded attachment feature (the details of which form no part of the present invention) for installation of the closure 20 on the bottle which would mate with the attachment configuration on the bottom of the body 24.

The closed closure 20 would typically be shipped to a pouch manufacturer or bottler which would provide a containment system (e.g., a pouch or bottle, not illustrated), and the pouch manufacturer or bottler would install the closure 20 on the pouch or bottle. The particular containment system (e.g., pouch or bottle) may have already been filled with product. Alternatively, the closure 20 may be installed on an empty containment system which is subsequently filled with product through an open bottom end of the containment system which is thereafter sealed closed.

The bottom of the base 40 can readily be provided with various attachment configuration features (not shown) suitable for a particular application—especially for a pouch or a bottle having semi-rigid, resilient walls, or having rigid walls. For example, the base 40 can be provided with suitable snap-fit engagement beads (not illustrated) for engaging complementary or mating features on the bottle (not illustrated) or other system. Such an engagement would resist removal of the closure 20 by a user of the package. In an alternate arrangement (not illustrated), the closure body 24 could have a lower, round end with a thread for threadingly engaging a mating thread of a bottle (not illustrated) or other system.

Further, other means of providing a generally non-removable or removable attachment of the closure 20 to the container (not illustrated) or other system are contemplated. These other means could include the use of a suitable mechanical lock, spin welding of the closure to the system, mechanical staking, adhesive, etc.

The access passage 30 extends from the distal, outer end 43 of the spout 42 and through the rest of the body 24. The access passage 30 communicates with an opening of the pouch 22 or bottle (not illustrated) or other system, and the passage 30 permits material (gases, fluids, solids, etc.) to pass between the exterior and the interior of the system.

Figure 7:
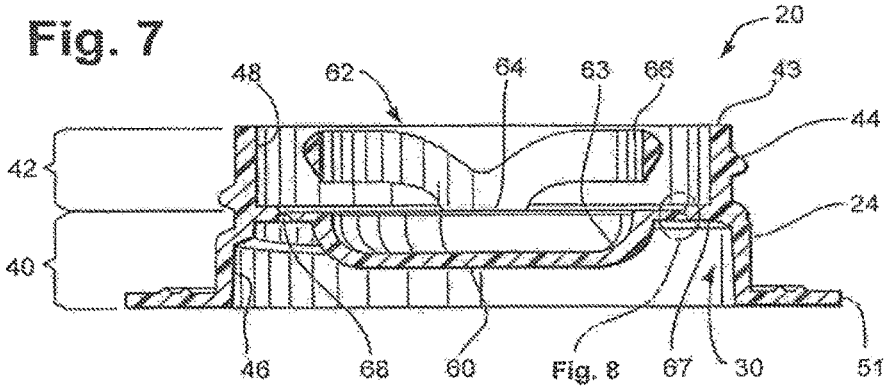
FIG. 7 is a cross-sectional view taken generally along the plane 7-7 in FIG. 5.

As best illustrated in FIGS. 6 and 7, the closure body 24 further includes a membrane 60. The membrane 60 is initially connected to the closure body 24 to initially occlude the access passage 30. In the preferred embodiment, the membrane 60 is a unitary portion of the closure body 24, which is initially molded as a unitary structure to include the membrane.

Figure 3:
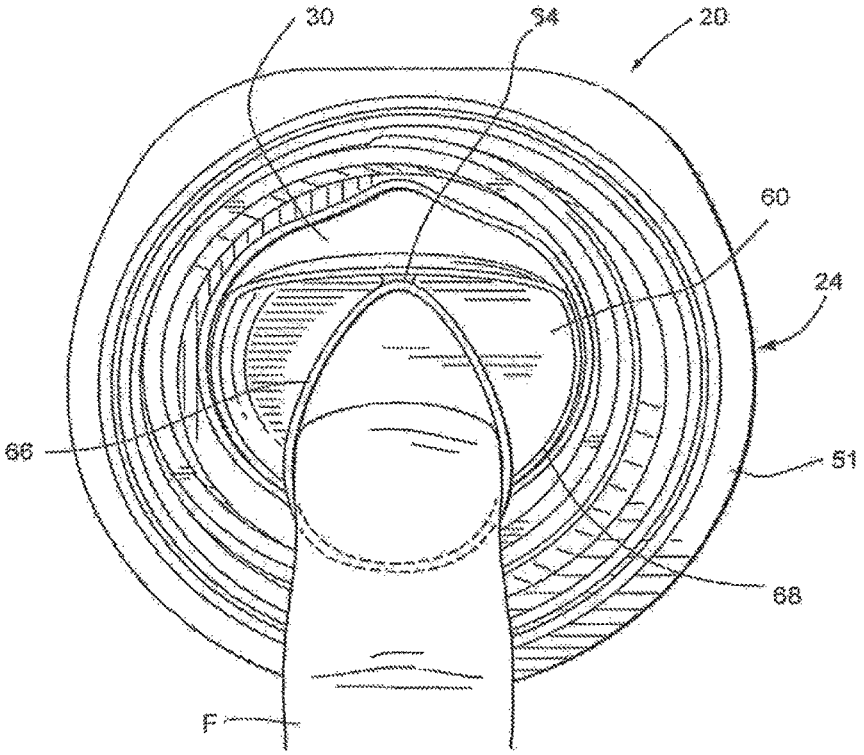
FIG. 3 is an isometric view of the closure shown in FIG. 2, but in FIG. 3 the closure is illustrated with the membrane being grasped by a user's finger, wherein the membrane has been torn only partly away from the closure body to a partially-open condition.
Figure 4:
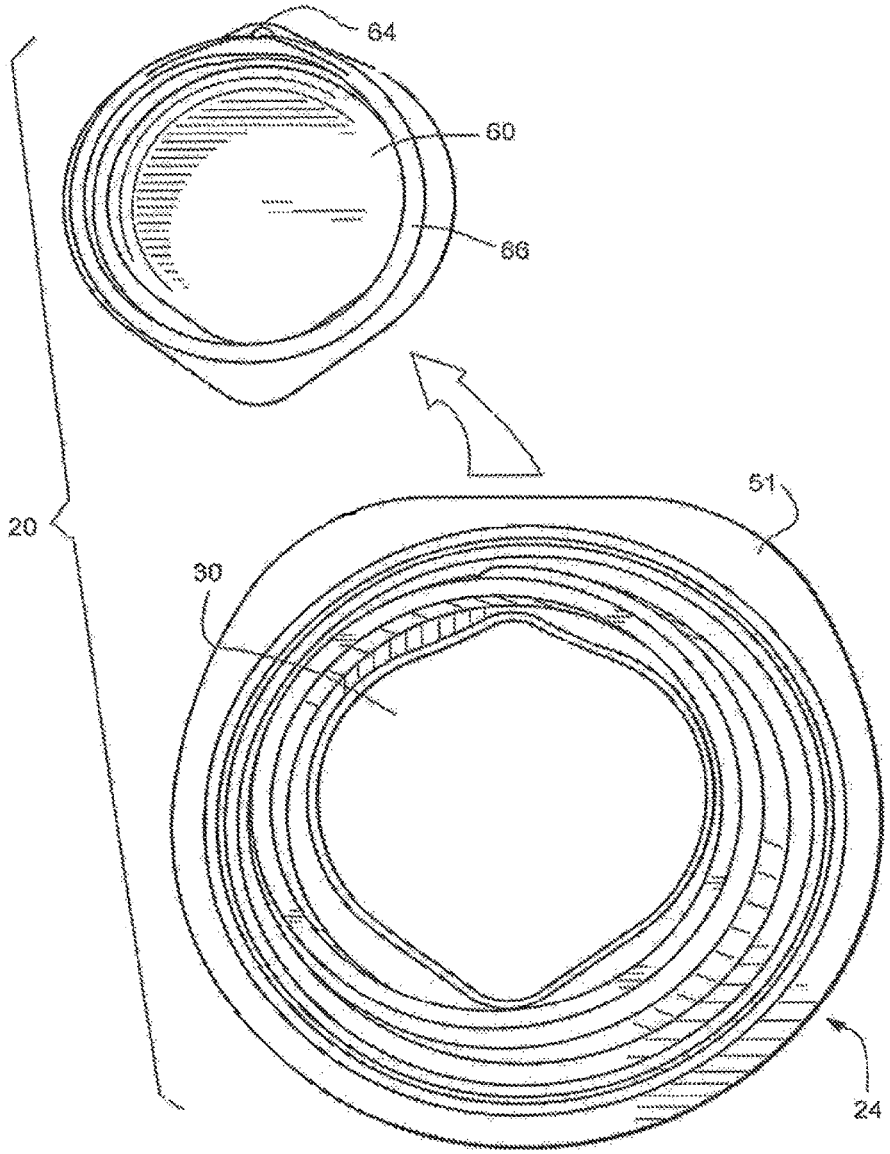
FIG. 4 is an isometric view of the closure shown in FIG. 3, but in FIG. 4 the closure is illustrated with the membrane torn completely away and removed so as to place the closure body in a fully-opened condition.

The membrane 60 further has a separation member 62 (FIG. 6) extending outwardly from the membrane 60. The separation member 62 is designed for engagement by a user to separate at least a part of the membrane 60 from the closure body 24 (as shown in FIGS. 3 and 4) as explained hereinafter. Complete or partial removal of the membrane 60 would indicate to a subsequent user that at least a portion of the closure 20 has been breached. Thus, the closure 20 can function as a tamper-evident closure.

As further illustrated in FIGS. 6 and 7, the membrane 60 may have a concave region or recessed interior portion 63 for providing additional space for a tool or for a finger of the user so that the user can easily engage the separation member 62 and pull on it to separate at least part of the membrane 60 from the closure body 24. It will be appreciated, that in the broadest concept of the present invention, the membrane 60 need not be provided with a recessed interior portion 63.

The separation member 62, in the first illustrated embodiment of the closure 20 as best seen in FIG. 6, preferably includes a stem 64 extending outwardly from the membrane 60. The separation member 62 may also include a grippable portion 66 that extends laterally from the upper end of the stem 64. In the first illustrated embodiment of the closure 20, the grippable portion 66 is in the form of a ring. It will be understood, that the grippable portion 66 may take the form of another shape that is not a ring, such as a tail, polygon, or other suitable projecting member to be engaged by a user of the closure 20. It will further be appreciated that the stem 64 and grippable portion 66 may be provided in a variety of configurations and extend from the membrane 60 in a variety of configurations.

By providing the separation member 62 in the form of a stem 64 and a grippable portion 66, a user may grip and remove the membrane 60 more easily. It will be understood, however, that in the broadest concept of the present invention, the separation member 62 need not have a discernible stem 64 or grippable portion 66. The separation member 62 may be of any suitable geometry that will allow a user to separate the membrane 60 from the closure body 24 by gripping the separation member 62 between user's thumb and finger, or by gripping or hooking it with a tool.

The membrane 60, in FIG. 6, is depicted as being connected to the rest of the closure body 24 at a an intermediate interior flange or surface 67 of the closure body 24 between the first interior surface 46 and the second interior surface 48. However, it will be understood that the membrane 60 may alternatively be connected to the closure body 24 at the second interior surface 48 of the spout 42. The membrane also may alternatively be provided in the first interior surface 46 of the base 40 to occlude the access passage 30.

Figure 8:
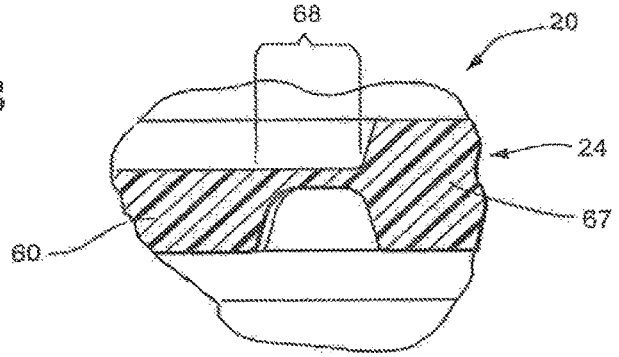
FIG. 8 is a fragmentary, enlarged, cross-sectional view of the closure shown in the circle labeled "FIG. 8" in FIG. 7.
Figure 9:
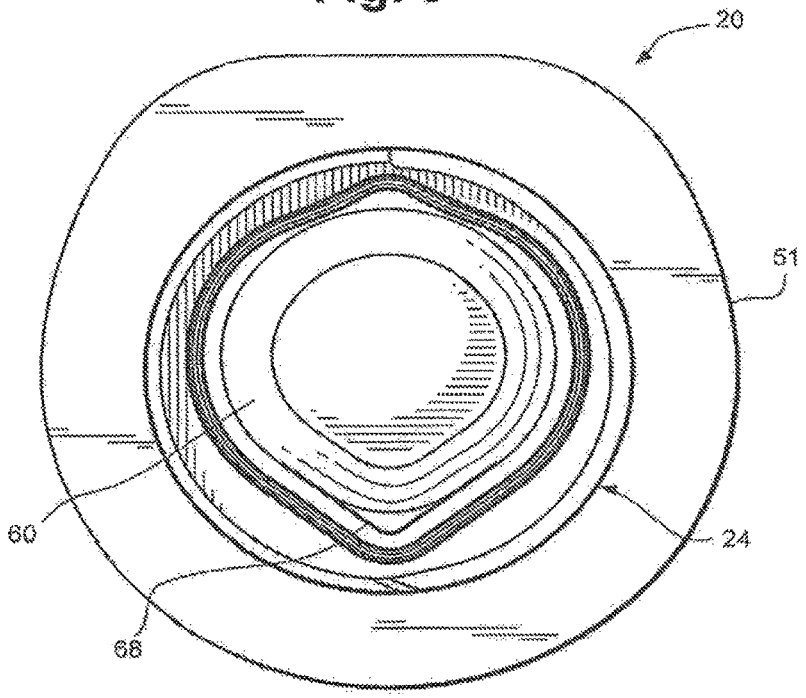
FIG. 9 is bottom plan view of the closure shown in FIG. 2.

As shown in FIG. 8, the connection of the membrane 60 to the rest of the closure body 24 can be defined by a peripheral, or tearable portion 68 of the membrane 60. The tearable portion 68 is a tearable portion of the material that defines a tear path 70 (only illustrated in FIG. 5A) along which the membrane 60 material can be torn. In the presently preferred form of the closure 20, the tearable portion 68 is a weakened area or region. The weakened area defined by the tearable portion 68 is a region of reduced cross-sectional thickness compared to a laterally inward portion of the membrane 60. When a user of the closure 20 tears the membrane 60 from the closure body 24 (as discussed below), the weakened area permits the user to employ a lower force to remove the membrane 60 from the body 24. After the user has torn the membrane 60 from the closure body 24, there may be a small remnant (not illustrated) of the peripheral, tearable portion 68 that remains attached to the rest of the body 24 while most of the membrane 60 remains intact and separate from the closure body 24. Further, other means of providing a peripheral, tearable portion 68 with a weakened area are contemplated. These means could include, among other things, the following: use of material weakening by residual internal stress; subjecting the peripheral, tearable portion 68 to dynamic stress; or die cutting, etching, or chemical treating of the peripheral, tearable portion 68 to create the weakened area.

In the presently preferred embodiment of the present invention, the tearable portion 68 of the membrane 60 has a reduced thickness along a limited section of the tear path 70 when compared to the thickness of the tearable portion 68 along the remainder of the tear path 70 beyond the limited section. Specifically, and with reference to FIG. 5A, a length of the tearable portion 68 proximal the stem 64 (from about the "11 o'clock" location in FIG. 5A to about the "1 o'clock" location in FIG. 5A) has a thickness of about 0.114 millimeters whereas the remaining tearable portion 68 has a thickness of about 0.140 millimeters. This reduction of thickness of the tearable portion 68 proximal the stem 64 permits the user to employ a lower force when initially beginning to remove the membrane 60 from the body 24 when compared to an equivalent tearable portion having a uniform, but greater, thickness of about 0.140 millimeters. Preferably, only a small length of the tear path 70 has the reduced thickness. If the entire length, or large part of the length, of the tear path 70 was very thin, then it might be difficult for the manufacturer to properly control the thickness during molding of the closure. An attempt to extend the reduction of the thickness of the tearable portion 68 around the entire tear path 70 may risk a greater occurrence of defects such as pin holes and voids developing in the tearable portion 68, thus reducing the sealing capability of the membrane 60. In the presently preferred embodiment of closure 20, the reduction of thickness of the tearable portion 68 is generally limited to less than twenty percent of the total length of the tear path 70 adjacent the stem 64.

The inventors have discovered that the force required to tear the peripheral, tearable portion 68 may be controlled in an attempt to prevent, or at least minimize, undesirable slinging or splattering of the contents of a container during removal of the membrane 60 as discussed above in the "Background Of The Invention" section. The inventors have discovered that this can be accomplished by providing a peripheral, tearable portion 68 with a special configuration of the tear path 70.

Figure 5:
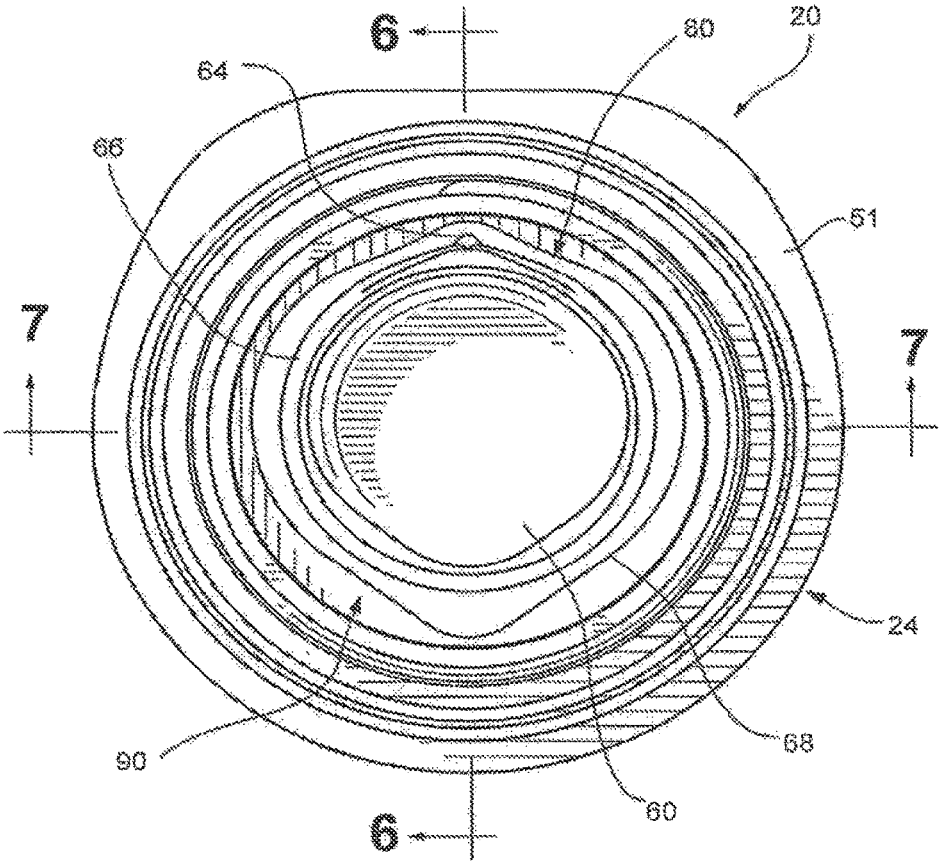
FIG. 5 is a top plan view of the unopened closure shown in FIG. 2.
Figure 5A:
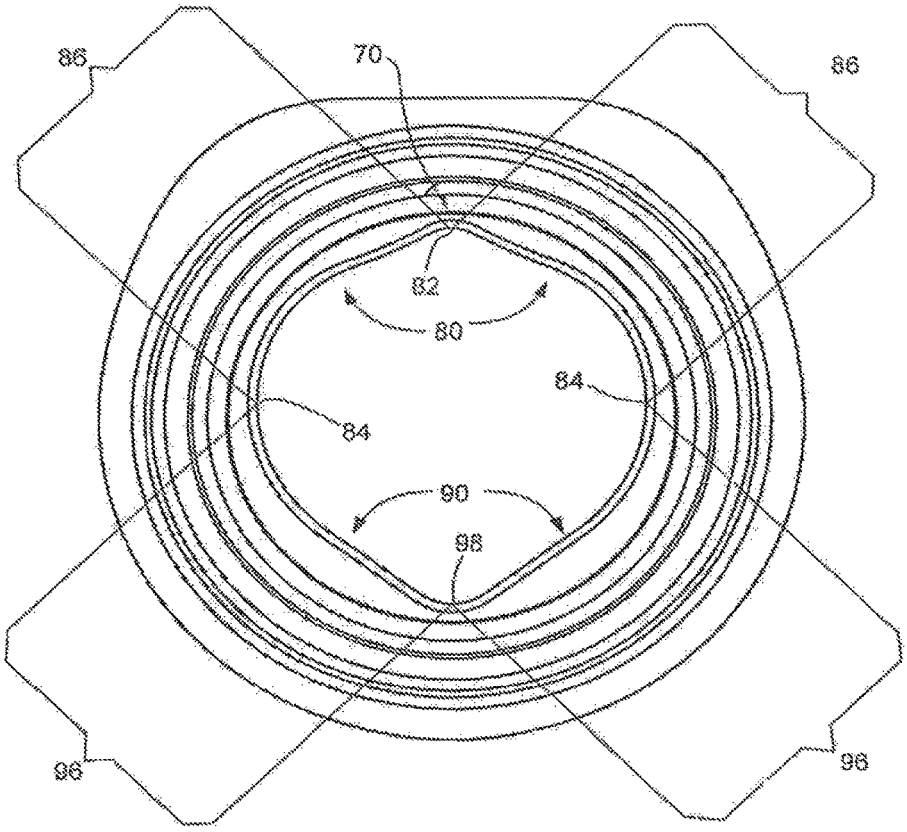
FIG. 5A is a simplified, diagrammatic, top plan view of the body of the opened closure shown in FIG. 4 wherein the membrane has been completely removed from the closure body.

As can best be seen in FIG. 5A, the tear path 70 is further defined as having a first separation path 80 where separation of the membrane 60 from the rest of the body 24 initially originates. Preferably, the first separation path 80 has a starting point 82 adjacent the region where the separation member 62 is attached to the membrane 60, and has two ending points 84. The starting point 82 and the two ending points 84 may be characterized as defining two generally diverging lines 86 that diverge from the starting point 82. Such generally diverging lines 86 may have the form of an arc, a complex curve with one or more points of inflection, or one or more straight lines.

The tear path 70 further includes a second separation path 90 where separation of the membrane 60 from the body 24 terminates. The second separation path 90 preferably defines two converging lines 96 each extending from a respective one of the first separation path ending points 84 to a termination point 98.

In the broadest concept of the present invention, the second separation path 90 has a generally tapered configuration. This tapered configuration is designed to decrease the pull force required of the user of the closure 20 when the user pulls on the separation member 62 during tearing of the peripheral, tearable portion 68 along the second separation path 90. The decreased force requirement allows the user to decrease the force with which the user pulls on the separation member 62 as the membrane 60 tears away along the path 90 in the region of, and approaching, the termination point 98, where the membrane 60 is completely separated from, and free of, the closure body 24. The reduction in the required force allows less force to be applied at the end of the tearing process so that the membrane 60 is less likely to be jerked violently away and cause some product to be flung off from the membrane 60 or ejected from the container (e.g., the pouch 22 in FIG. 1).

Testing has shown that, in comparison to comparable prior art fully-circular membranes, the tapered configuration of the second separation path 90 of the present invention provides a reduction of pull force for separation of the membrane 60 proximal the termination point 98. The pull force required to completely pull away a comparable prior art fully-circular membrane, along a semi-circular second separation path proximal the termination point, has been found in tests to be greater than the pull force required to completely pull away the inventive membrane with a tapered configuration disclosed herein. This difference is discussed further below.

Figure 11:
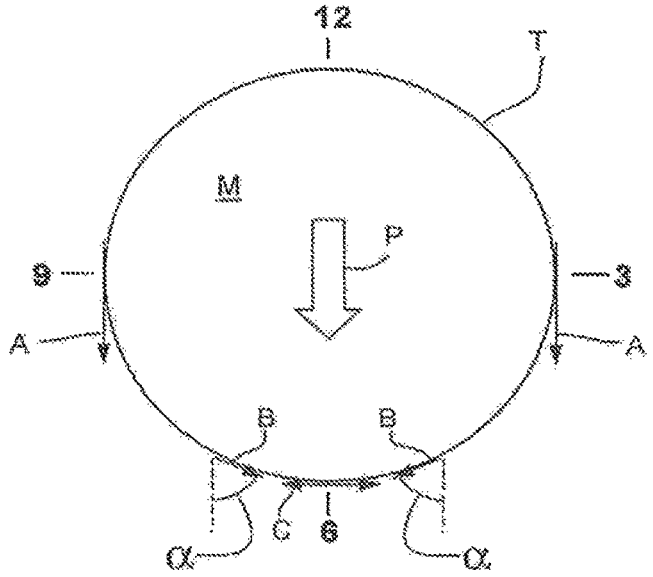
Fig. 11 Prior Art
FIG. 11 is a simplified, diagrammatic, top plan view of a prior art membrane.

A prior art membrane M with a fully-circular tear path T is illustrated diagrammatically in FIG. 11. A user grips the membrane M by a separation member (e.g., pull ring (not illustrated)) and pulls the separation member in such a way that the user's hand typically moves in a generally horizontal direction P, from a "12 o'clock" starting point toward a "6 o'clock" termination point. This pulling action imposes a pulling force on the membrane M to cause the membrane M to tear away along the tear path T beginning at the "12 o'clock" starting point. An initial portion of the membrane M at the "12 o'clock" starting point is torn up and away from the closure body (not illustrated), and, as the user's hand continues to move generally horizontally toward the "6 o'clock" termination point, the remaining portions of the tear path T are torn along each side of the membrane M until the membrane M becomes completely separated from the closure body.

Still referring to FIG. 11, it can be seen that at the "3 o'clock" and "9 o'clock" locations on the tear path T, the peripheral portion of the prior art membrane M is subjected to a shearing or tearing force in a direction generally parallel to the direction P in which the user's hand is moving as the user's hand moves from the "12 o'clock" location toward the "6 o'clock" location. The "3 o'clock" and "9 o'clock" locations on the prior art tear path T mark the end of the first 180 degrees of the tear path T (90 degrees on each side) and mark the beginning of the second 180 degrees of the tear path T (90 degrees on each side). As the user continues to pull the membrane M, the tearing continues from the "3 o'clock" and "9 o'clock." locations toward the "6 o'clock" termination point where the direction of the prior art tear path T becomes substantially normal (i.e., perpendicular) to the direction P of the movement of the user's hand.

Still referring to FIG. 11, representative directions of the tearing along the tear path T are indicated by tangent lines A (at the "3 o'clock" and "9 o'clock" locations), tangent lines B (at a location between the "3 o'clock" location and "6 o'clock" termination point, and at a location between the "9 o'clock" location and "6 o'clock" termination point), and tangent line C (at the "6 o'clock" termination point). An angle $\alpha$ is defined between each of the tangent lines A, B, C and the direction of hand movement P. At the "3 o'clock" and the "9 o'clock" locations the angle $\alpha$ is about 0 degrees. At the "6 o'clock" termination point, the angle $\alpha$ is about 90 degrees. As the angle $\alpha$ increases from about 0 degrees to about 90 degrees at the "6 o'clock" termination point, the user must exert an ever-increasing, relatively larger pulling force in order to effectuate the final and complete separation of the prior art membrane M from the rest of the prior art closure body (not illustrated).

Figure 12:
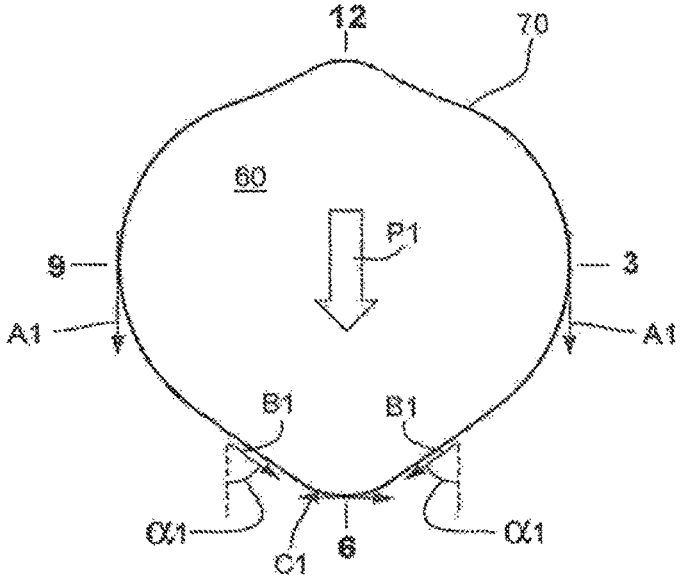
FIG. 12 is a simplified, diagrammatic, top plan view of the membrane of the closure shown in FIG. 5.

An embodiment of the inventive membrane 60 with a generally tapered tear path 70 is illustrated diagrammatically in FIG. 12. A user grips the membrane 60 by a separation member (e.g., pull ring (not illustrated in FIG. 12)) and pulls the separation member in such a way that the user's hand typically moves in a generally horizontal direction P1, from a "12 o'clock" starting point toward a "6 o'clock" termination point. This pulling action imposes a pulling force on the membrane 60 to cause the membrane 60 to tear away along the tear path 70 beginning at the "12 o'clock" starting point. An initial portion of the membrane 60 at the "12 o'clock" starting point is torn up and away from the closure body (not illustrated in FIG. 12), and, as the user's hand continues to move generally horizontally toward the "6 o'clock" termination point, the remaining portions of the tear path 70 are torn along each side of the membrane 60 until the membrane 60 becomes completely separated from the closure body.

Still referring to FIG. 12, it can be seen that at the "3 o'clock" and "9 o'clock" locations on the tear path 70, the peripheral portion of the membrane 60 is subjected to a shearing or tearing force in a direction generally parallel to the direction P1 in which the user's hand is moving. Beyond the "3 o'clock" and "9 o'clock" locations toward the "6 o'clock" termination point, the tear path 70 includes two straight (or reduced curvature) portions defining a tapered configuration defined by the two converging lines of the second separation path (e.g., second separation path 96 in FIG. 5A).

In FIG. 12, representative directions of the inventive tear path 70 are indicated by tangent lines A1 (at the "3 o'clock" and "9 o'clock" locations), tangent lines B1 (at a location between the "3 o'clock" location and the "6 o'clock" termination point, and at a location between the "9 o'clock" location and the "6 o'clock" termination point), and tangent line C1 (at the "6 o'clock" termination point). Angle $\alpha$1 is defined between each of the tangent lines A1, B1, C1 and the direction of hand movement P1. At the "3 o'clock" and "9 o'clock" locations, the angle $\alpha$1 is about 0 degrees. The angle $\alpha$1 generally increases from 0 degrees as tearing propagates along the tear path 70 from the "3 o'clock" and "9 o'clock" locations toward the "6 o'clock" termination point. In the tapered configuration of the inventive tear path 70, there is at least a portion of the tear path 70 at or near the "6 o'clock" termination point Where the angle α1 is less than the angle α at an equivalent location of the prior art fully-circular tear path M (cf. FIGS. 11 and 12). For example, tangent lines B1 (FIG. 12) of the inventive tear path 70 have an angle α1 that is less than the angle α of the prior art tangent lines B (illustrated in FIG. 11) even though both tangent lines B and B1 are located in the same angular positions between "3 o'clock" and "6 o'clock" locations, and between "9 o'clock" and "6 o'clock" locations with reference to the face of a clock. The decreased angle α1 at tangent lines B1 for the present invention, in comparison to angle α at tangent lines B of the prior art, results in a decreased pull force requirement from the user in order to effectuate the separation of the membrane 60 from the rest of the closure body (24 in FIG. 5) when compared to the greater pull force required to effect separation of the prior art membrane M from the prior art closure body.

The reduction in force required from the user in order to effectuate final and complete separation of the inventive membrane 60 from the rest of the closure body is the result of maintaining a shearing or tearing force that is more aligned with the tear path 70 near the "6 o'clock" termination point 98 (FIG. 5A) for at least a portion of the second separation path 90 near the "6 o'clock" termination point 98, rather than an almost perpendicular tensile or pulling force proximal the "6 o'clock" termination point of the prior art membrane M. Preferably, the inventive closure 20 minimizes the amount of tensile or pulling force that is substantially perpendicular to the direction of the second separation path 90 proximal the termination point 98, in the plane of the tear path 70.

As can further be seen in FIG. 5A, in the presently preferred embodiment of the closure 20, the second separation path termination point 98 is located on a curved locus defined by the convergence of the two converging lines 96. Furthermore, as illustrated, the preferred embodiment at least a portion of each converging line 96 is a straight line. Preferably, the straight lines 96 define an interior angle that is greater than 90 degrees. In the broadest concept of the invention, however, it is understood that the convergence of the two converging lines 96 may have other configurations, such as vertex (not illustrated) or a complex curvature with one or more points of inflection (not illustrated). Further, in some applications, the straight lines 96 may define an interior angle that is acute.

The preferred configuration of the tear path 70 illustrated in FIG. 5A further has a first separation path 80 and second separation path 90 that connect at the first separation path ending points 84 on a curve. In the broadest concept of the invention, however, it is understood that the convergence of the first separation path 80 and second separation path 90 may have other configurations, such as vertex (not illustrated) or a complex curvature with one or more points of inflection (not illustrated).

As can further be seen in FIG. 5, in the presently preferred embodiment of the closure 20, at least one of the first separation path 80 and the second separation path 90 has symmetry about the access passage 30. Symmetry is determined from a vantage point normal to a plane defined by the membrane 60, particularly the peripheral portion 68, and is defined by lines drawn through a geometric center point of the access passage 30. Furthermore, as illustrated in the preferred embodiment, both the first separation path 80 and the second separation path 90 have symmetry about the line taken from the center of the access passage 30 to the termination point 98. In the broadest concept of the invention, however, it is understood that the first separation path 80 and the second separation path 90 need not have symmetry about the access passage 30 and may have other configurations, such as asymmetric or irregular paths.

As illustrated in FIG. 5A, the preferred embodiment of the closure 20 has portion of the first separation path 80 that defines a diameter extending through a center point, wherein the shortest distance from the center point of the diameter to the termination point 98 is greater than one half of the diameter.

The inventors have experimented with alternative means in order to prevent the aforementioned unwanted slinging or ejection of the fluent contents of a container during removal of the membrane 60. Controlling the tearing force of the peripheral, tearable portion 68 may be accomplished by providing a peripheral, tearable portion 68 with a configuration of decreasing thickness along the two converging lines 96 that terminate at the termination point 98. However, such a configuration of a tearable portion 68 with a decreasing thickness can result in additional undesirable characteristics in the closure 20 such as pin holes or voids forming in the tearable portion 68. Such pin holes or voids can lead to a decrease in the seal quality of the membrane 60 and a decrease in the visual aesthetic of the overall closure 20.

It will be noted that in FIG. 5A, the first illustrated embodiment of closure 20 has a first separation path 80 that is not in the form of a semi-circle or arc. Instead, the first illustrated embodiment of the closure 20 is shown with an outwardly convex stress concentration area or "bump" on the first separation path 80 at the starting point 82. It will be appreciated that the inventive closure of the invention, the tapered second separation path 90 may be utilized in a tear path 70 with a range of different geometries for the first separation path 80, such as a semi-circular configuration. Such a "bump" is not a feature of the invention claimed herein. It may be omitted from the first separation path 80. In some applications, such as the embodiment illustrated in FIGS. 1-10 and 12, a stress concentration area may be desired.

Figure 10:
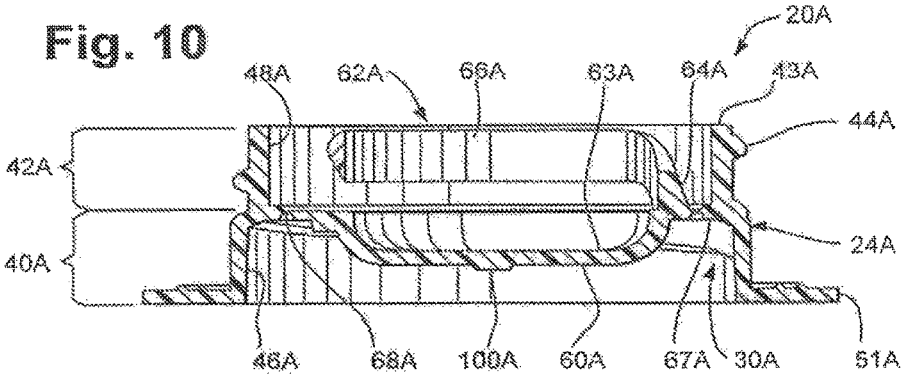
FIG. 10 is a cross-sectional view similar to FIG. 6, but FIG. 10 shows another embodiment of the closure.

A second illustrated embodiment of the closure 20A is only illustrated in FIG. 10. The second embodiment of the closure 20A is identical to the first embodiment of the closure 20, except that the second embodiment of the closure 20A has a membrane 60A with an injection boss 100A extending outwardly from the membrane 60A at a generally central location. The injection boss 100A defines the region at which the polymer resin is injected into the mold. The central location of the injection boss 100A reduces the chance for uneven filling of the peripheral, tearable portion 68A of the membrane 60A during the injection molding of the closure 20A. Uneven filling could result in voids or pinholes in the thin peripheral, tearable portion 68A. Placing the injection boss 100A at or near the center of the membrane 60A accommodates symmetric plastic flow from the boss 100A into the rest of the membrane 60A and through the peripheral, tearable portion 68A into the closure body 24A. However, it will be understood that in the broadest concept of the present invention, the membrane 60A need not have an injection boss 100A located in the center of the membrane 60A, or need not even have any injection boss 100A.

The present invention, can be summarized in the following statements or aspects numbered 1-14:

1. A closure that can selectively permit or restrict communication between the exterior and the interior of a system that has an opening between the exterior and interior, said closure comprising:

a closure body that (A) defines an access passage through said closure body for communicating with said system opening, and (B) is either (1) a separate structure for being attached to said system at said system opening, or (2) an integral structure that (a) is a unitary part of said system, and (b) includes said access passage through said integral structure to define at least a portion of said system opening, and wherein said closure body further has:

a membrane that (A) initially occludes said access passage, (B) is initially connected to a remaining portion of said body, and (C) includes a separation member that extends from a remaining portion of said membrane for accommodating engagement by a user to separate at least a part of said membrane from said body along at least a portion of the connection of said membrane to said body; and wherein the connection of said membrane to said body is defined by a tearable portion of material that defines a tear path along which said material can be torn, said tear path having: (A) a first separation path where separation of said membrane from said body initially originates; and (B) a second separation path where separation of said membrane from said body terminates; and said second separation path has a generally tapered configuration.

2. The closure in accordance with aspect 1 in which said first separation path has a starting point and two ending points and in which said second separation path has a termination point, said starting point and said two ending points defining two diverging lines diverging from said starting point, said second separation path defining two converging lines each extending from a respective one of said first separation path ending points to said termination point of said second separation path, whereby said membrane can be separated from said body along the entire connection of said membrane to said body.

3. The closure in accordance with aspect 2 in which said second separation path termination point is on a curved locus defined by the convergence of said two converging lines.

4. The closure in accordance with aspect 2 in which said first separation path and said second separation path connect at said first separation path ending points on a curve.

5. The closure in accordance with aspect 2 in which at least part of said first separation path defines a diameter extending through a center point, and wherein the shortest distance from said center point to said termination point is greater than one half of said diameter.

6. The closure in accordance with aspect 2 in which at least a portion of each converging line is a straight line.

7. The closure in accordance with aspect 6 in which said straight lines define an interior angle that is greater than 90 degrees.

8. The closure in accordance with any of the preceding aspects in which at least one of said first separation path and said second separation path has symmetry about said access passage.

9. The closure in accordance with any of the preceding aspects for use with a system that includes a bottle defining said opening, and wherein said body is initially separate from, but non-releasably attachable to, said bottle at said opening.

10. The closure in accordance with any of the preceding aspects for use with a system that is a flexible pouch defining said opening and wherein part of said body is a fitment adapted for being sealingly secured to said flexible pouch in said opening.

11. The closure in accordance with any of the preceding aspects in which said body includes a base and a spout projecting outwardly from said base; and said access passage extends through both said base and said spout.

12. The closure in accordance with aspect 11 in which said membrane is located within said spout.

13. The closure in accordance with any of the preceding aspects in which said separation member includes: (1) a stem extending outwardly from said membrane; and (2) a grippable portion extending laterally from said stem.

14. The closure in accordance with any of the preceding aspects in which said membrane has a recessed interior portion.

15. The closure in accordance with any of the preceding aspects in which said tearable portion of said membrane has a reduced thickness proximal where said separation member extends from said membrane.

What is claimed is:

1. A closure for selectively permitting or restricting communication between the exterior and the interior of a system that has an opening between the exterior and interior, said closure comprising;

a closure body that (A) defines an access passage through said closure body for communicating with a system opening, and (B) is either (1) a separate structure for being attached to a system at a system opening, or (2) an integral structure that (a) is a unitary part of a system, and (b) includes said access passage through said integral structure to define at least a portion of a system opening, and wherein said closure body further has:

a membrane that (A) initially occludes said access passage, (B) is initially connected to a remaining portion of said closure body, and (C) includes a separation member that extends from a remaining portion of said membrane for accommodating engagement by a user to separate at least a part of said membrane from said closure body along at least a portion of the connection of said membrane to said closure body: and wherein the connection of said membrane to said closure body is defined by a tearable portion of material that defines a tear path along which said material is configured to be torn, said tear path having: (A) a first separation path where separation of said membrane from said closure body initially originates; ,and (B) a second separation path where separation of said membrane from said closure body terminates; and said second separation path has a tapered configuration, said tearable portion of material has a reduced thickness along said first separation path proximal where said separation member extends from said membrane compared to a thickness of said tearable portion of material along said second separation path, and said reduced thickness of said tearable portion of material along said first separation path is limited to less than 20% of a total length of the tear path.

2. A closure for selectively permitting or restricting communication between the exterior and the interior of a system that has an opening between the exterior and interior, said closure comprising:

a closure body that (A) defines an access passage through said closure body for communicating with a system opening, and (B) is either (1) a separate structure for being attached to system at a system opening, or (2) an integral structure that (a) is unitary part of a system, and (b) includes said access passage through said integral structure to define at least a portion of a system opening, and wherein said closure body further has;

a membrane that (A) initially occludes said access passage, (B) is initially connected to a remaining portion of said closure body, and (C) includes a separation member that extends from a remaining portion of said membrane for accommodating engagement by a user to separate at least a part of said membrane from said closure body along at least a portion of the connection of said membrane to said closure body; and wherein the connection of said membrane to said closure body is defined by a tearable portion of material that defines a tear path along which said material is configured to be torn, said tear path having; (A) a first separation path where separation of said membrane from said closure body initially originates; and (B) a second separation path where separation of said membrane from said closure body terminates; and said second separation path has a tapered configuration, and said tearable portion of material has a thickness that is about 20% reduced near the separation member, when compared to a thickness of said tearable portion of material along said second separation path.

* * * * *